US007353793B1

(12) United States Patent
Estacio

(10) Patent No.: US 7,353,793 B1
(45) Date of Patent: Apr. 8, 2008

(54) HOLD DOWN PLATE FOR SECURING A COMPONENT

(75) Inventor: Edgardo Y. Estacio, Itasca, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/671,839

(22) Filed: Feb. 6, 2007

(51) Int. Cl.
*F01P 7/16* (2006.01)

(52) U.S. Cl. ..... 123/195 A; 123/198 R; 123/41.08

(58) Field of Classification Search ..... 123/195 A, 123/198 R, 41.01, 41.08, 195 C
See application file for complete search history.

(56) References Cited

U.S. PATENT DOCUMENTS 6,112,706 A * 9/2000 Heer ..... 123/41.1
6,612,270 B2 * 9/2003 Fegg et al. ..... 123/41.44
6,843,209 B2 * 1/2005 Miyagawa et al. ..... 123/41.1
6,978,742 B2 * 12/2005 Miyagawa et al. ..... 123/41.1
7,063,048 B2 * 6/2006 Ieda ..... 123/41.1

* cited by examiner

*Primary Examiner*—Hai Huynh
(74) *Attorney, Agent, or Firm*—Jeffrey P. Calfa; Gerald W. Askew

(57) ABSTRACT

A hold-down plate (500) for securing a first component (104) to a second component (400) having a seal (416) disposed between the first component (104) and the second component (400), includes a support member (502) having a central opening (504). The support member (502) has an outer face (510), and an inner face (512), that are substantially flat. The central opening (504) is surrounded by an inner periphery (508) of the support member (504), and an outer periphery (506). A plurality of guide elements (520) is disposed into each of a plurality of openings (518) formed in the support member (502), each of the plurality of guide elements (520) having an outer wall (522) surrounding a central cavity (524). The support member (502) has at least two distal end points (514), each distal end point (514) disposed between two consecutive openings (518), and at least two non-flat portions (516) formed in the support member (502), each non-flat portion (516) disposed between two consecutive openings (518).

12 Claims, 4 Drawing Sheets

-PRIOR ART-

-PRIOR ART-

-PRIOR ART-

HOLD DOWN PLATE FOR SECURING A COMPONENT

FIELD OF THE INVENTION

This invention relates to internal combustion engines, including but not limited to use of a hold-down plate to connect a first component with a second component on an internal combustion engine.

BACKGROUND OF THE INVENTION

Internal combustion engines often have components sealably connected to them that perform various functions. Examples of such components include valve covers, oil pans, thermostat housings, and so forth. One common trait of such components is that they are mounted to a base engine structure by fasteners that are secured to the base engine structure and clamp the component through a bolt opening formed in a flange of the component. One other common trait is that, usually, these components sealably contain an internal volume of the engine that contains fluids. Gaskets or other types of seals are generally placed at a flange interface between such a component and the base engine structure. A placement of the fasteners to connect the component to the engine around a periphery of the flange interface is typically determined according to the "clamp load" that is desired on the seal. The clamp load is a pressure applied locally to the seal from an adjacent fastener.

Typical design guidelines require a uniform clamp load around a periphery of a sealed flange interface for proper performance of the seal therebetween. This typically results in a relatively larger number of fasteners used to secure a flange interface for proper sealing than the number of fasteners needed to carry any stresses in the interface. The larger number of fasteners used is not only more costly, it also presents issues when serviceability and access considerations make it difficult to remove some of these fasteners for service.

Accordingly, there is a need for an improved sealed flange interface configuration that is capable yielding an adequate clamp load for a seal with use of a minimal number of fasteners.

SUMMARY OF THE INVENTION

A hold-down plate for securing a first component to a second component having a seal disposed between the first component and the second component includes a support member having a central opening. The support member has an outer face and an inner face that are substantially flat. The central opening is surrounded by an inner periphery of the support member, and an outer periphery. A plurality of guide elements is disposed into each of a plurality of openings formed in the support member, each of the plurality of guide elements having an outer wall surrounding a central cavity. The support member has at least two distal end-points, each distal end-point disposed between two consecutive openings, and at least two non-flat portions formed in the support member, each non-flat portion disposed between two consecutive openings.

DESCRIPTION OF A PREFERRED EMBODIMENT

The following describes an apparatus for and method of providing a hold-down plate that replaces a typical flange connection configuration for connecting one component to another. The hold-down plate advantageously imparts a more uniform clamp loading on an interface between the components, which is advantageous for a sealing performance of a seal that might be located therebetween. Additionally, the hold-down plate may advantageously reduce the number of fasteners used to connect the two components as compared to the fasteners that would be required to connect the components based on stress experienced by the interface.

Figure 1:
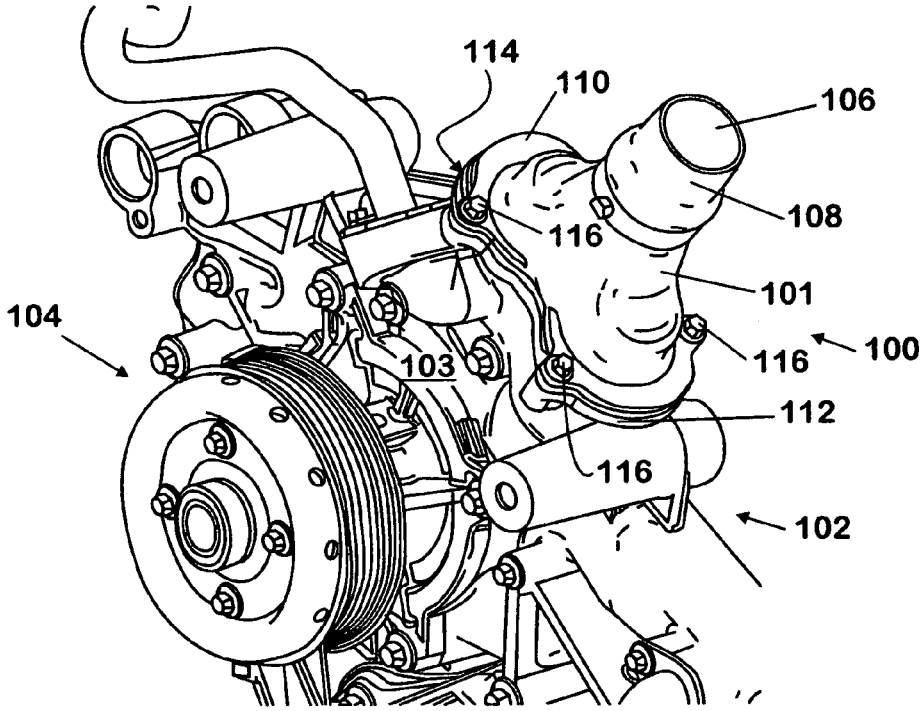
FIG. 1 is an outline view of an engine having a component attached thereon.

A particular outline view of a known connection configuration between a first component 100, for example a thermostat housing 101, and a second component 102, for example a front module 103, on an internal combustion engine 104 is shown in FIG. 1. The engine 104 may have other components attached thereon. The housing 101 of the first component 100 has an opening 106 formed therein for passage of a fluid therethrough, in this example for passage of engine coolant, and an interface 108 formed around the opening 106 for attachment of a fluid passage (not shown) thereon.

The housing 101 has a flange 110 formed thereon that is used to interface with a mating flange 112 on the second component 103. A seal 114 is located between the flange 110 and the mating flange 112 to fluidly-seal a connection interface between the flange 110 and the mating flange 112. The seal 114 may be a flat gasket, or may alternatively be a press-in-place seal. A plurality of fasteners 116 are used to connect the flange 110 with the mating flange 112. In this case, the plurality of fasteners 116 consists of four fasteners that are located in a symmetrical pattern around the flange 110.

Figure 2:
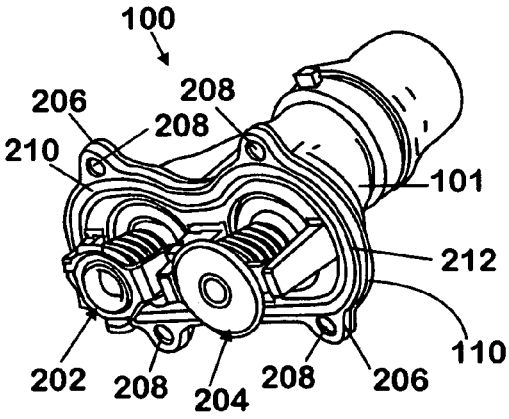
FIG. 2 is an outline view of the component from a bottom perspective.

An outline view of the first component 100 from a flange 110 perspective is shown in FIG. 2. The first component 100 has a first thermostat assembly 202 and a second thermostat assembly 204 connected thereto. The first and second thermostat assemblies 202 and 204 are immersed in a fluid, in this case coolant that occupies an internal volume that is enclosed by the housing 101, when the first component 100 is connected with the second component 102. The flange 110 forms a plurality of mounting bosses 206 that are located peripherally around an outer periphery of the flange 110 and whose locations correspond with a plurality of openings 208 that are used for mounting the flange 110 with the mating flange 112 by passing each of the plurality of fasteners 116 through each of the openings 208. In the example shown there are four openings 208 to correspond to each of the four fasteners 116, but other numbers of openings are formed in the flange 110.

The flange 110 forms a groove 210 that is close to the outer periphery of the flange 110 and extends completely around the outer periphery of the flange 110. The groove 210 partly houses a string seal 212 that flexibly conforms to the shape of the groove 208, is partially disposed therein, and that sealably engages the mating flange 112 when the first component 100 is connected to the second component 102. The string seal 212, and any seal, requires a uniform pressing load to be applied along its entire length for proper sealing between the first flange 110 and the mating flange 112. A uniform pressing load is advantageous for uniform sealing around the periphery of the flange 110.

Figure 3:
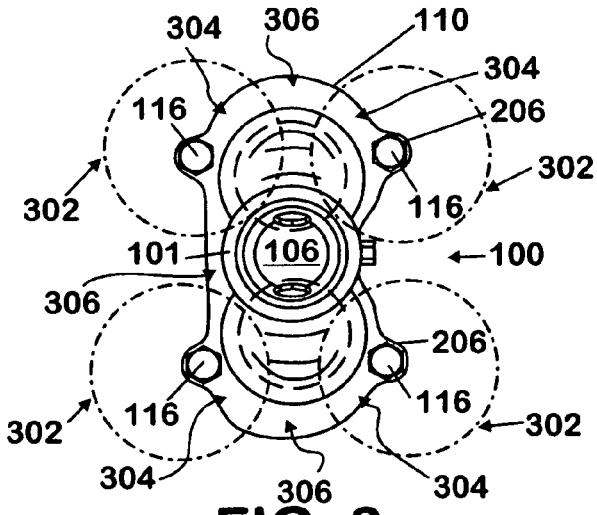
FIG. 3 is an outline view of the component in an as-installed position, from a top perspective, showing a loading condition on a flange thereof.

A partial outline view of the first component 100 is an as-mounted condition, from a perspective of the opening 106, is shown in FIG. 3. Each of the plurality of fasteners 116 is shown assembled into its respective opening 208 (shown hidden) in each of the bosses 206 around the periphery of the flange 110. When the plurality of fasteners 116 are assembled and tightened, they impart a pressing load between the flange 110 and the mating flange 112 (the mating flange not visible in this view). Each of the plurality of fasteners 116 has a "load circle" 302 associated therewith.

Each load circle 302 is an imaginary circular region that is centered at a centerline of a fastener. Each load circle 302 represents a region that is affected by a pressing load imparted by the fastener, when the fastener is installed and tightened, onto the flange 110. The load circle 302 increases in diameter as a tightening of a fastener increases and, therefore, a pressing load imparted by the fastener increases. A shape and size of a load circle for a flange interface, in general, depends on the size of fastener used, rigidity and flatness of each of the flanges in the flanges interfacing, and on the assembly tightness or installation-torque of the fastener.

Each load circle 302 represents a load-region 304 that is characterized in that a load is imparted, that is satisfactory for a sealing performance of the string-seal 212, by each respective fastener 116. Each load-region 304 is shown shaded for clarity. Each load region 304 is a circularly-shaped region that lies within each load-circle 302 that surrounds each fastener 116. Portions of the flange 110 that fall within a load region 304 experience an adequate pressing force. As it can be seen from FIG. 3, there are regions 306 of the flange 110 that fall outside of the load circles 302. These regions 306 are too far between the fasteners 116 to experience an adequate load for sealing of the string-seal 212.

Known design solutions that have been implemented to avoid having such regions 306 have included addition of additional fasteners and/or an increase of existing load-circle coverage by use of thicker flanges and/or larger fasteners. Some disadvantages of past solutions have been increases in weight and material cost of the components involved, as well as increased counts of parts used. These and other disadvantages may be avoided as described below.

Figure 4:
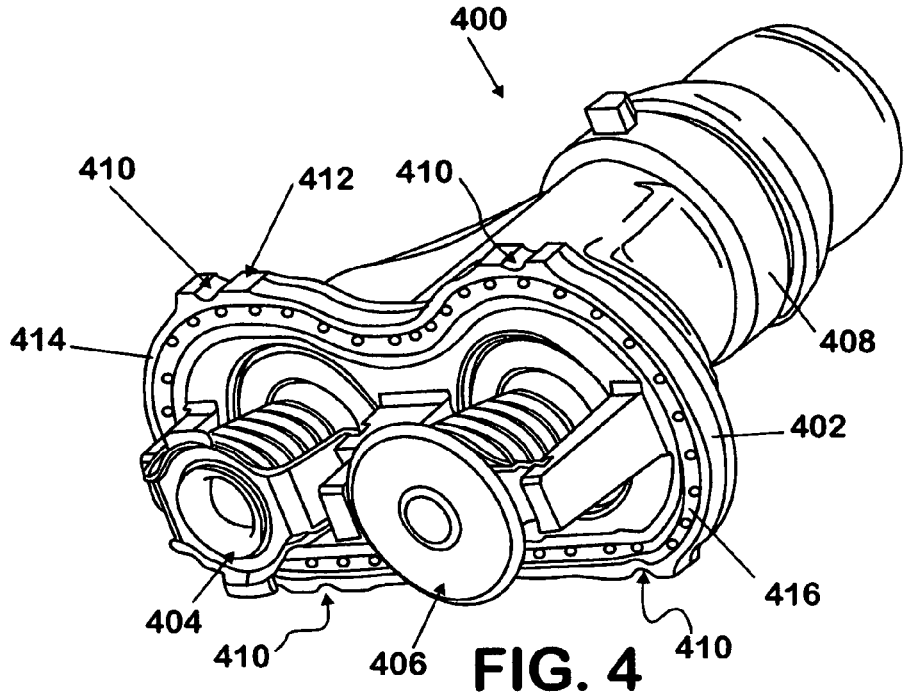
FIG. 4 is an outline view of a component having guide openings in accordance with the invention.

An outline view of an improved component 400 having a flange 402 formed thereon that can advantageously replace the component 100 described above on the engine 104 is shown in FIG. 4. In the example shown here, the component 400 is a thermostat housing that has a first thermostat assembly 404 and a second thermostat assembly 406 connected thereto. The flange 402 is formed on a housing 408 of the component 400. The flange 402 forms a plurality of guide channels 410 that are located peripherally around an outer periphery of the flange 402 and whose locations correspond with locations used for mounting the flange 402 to a mating flange (not shown) or another component to which the component 400 connects. In the example shown there are four guide-channels 410 to correspond to each of four fasteners (shown below). Each of the guide channels 410 may have a guide pad 412 on one or both lateral sides thereof that is formed in the flange 402. The guide pads 412 are used for aligning features of other components into each guide channel 410.

The flange 402 forms a groove 414 that is close to the outer periphery of the flange 402 and extends completely around the outer periphery of the flange 402. The groove 414 partly houses a string seal 416 that flexibly conforms to the shape of the groove 414, is partially disposed therein, and that sealably engages the mating flange when the component 400 is connected to a second component (not shown).

Figure 5:
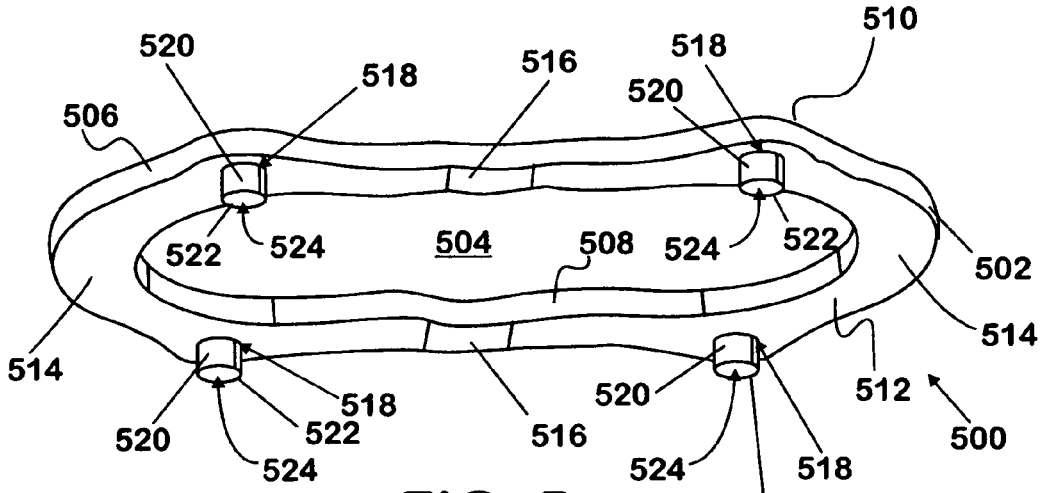
FIG. 5 is an outline view of a hold-down plate having guide elements and non-flat portions in accordance with the invention.

An outline view of a hold-down plate 500 is shown in FIG. 5. The hold-down plate 500 has a peripheral support member 502 that at least partially encloses an opening 504. The peripheral support member 502 has an outer periphery 506, an inner periphery 508, and may also advantageously have an outer face 510 and an inner face 512 that, apart from some features, are substantially flat.

The inner face 512 has two distal end-portions 514 and two non-flat portions 516. The non-flat portions 516 have segments thereof that at least partially extend away from the inner face 512. In the embodiment shown, the non-flat portions 516 are curves that have been formed into the support member 502 of the hold-down plate 500, but other methods may be used to create features that protrude out of the inner face 512. The distal end-portions 514 are shown flat, in this embodiment, but may also have features formed therein that protrude away from the inner face 512.

The support member 502 has a plurality of openings 518 that communicate between the outer face 510 with the inner face 512. Each of the plurality of openings 518 contains a guide element 520 that is at least partially inserted into each opening 518. Each guide element 520 has a substantially cylindrical shape that defines an outer wall 522 that is in contact with its respective opening 518, and a central cavity 524 that extends along the entire length of the wall 522 and that lies parallel to the opening 518.

Figure 6:
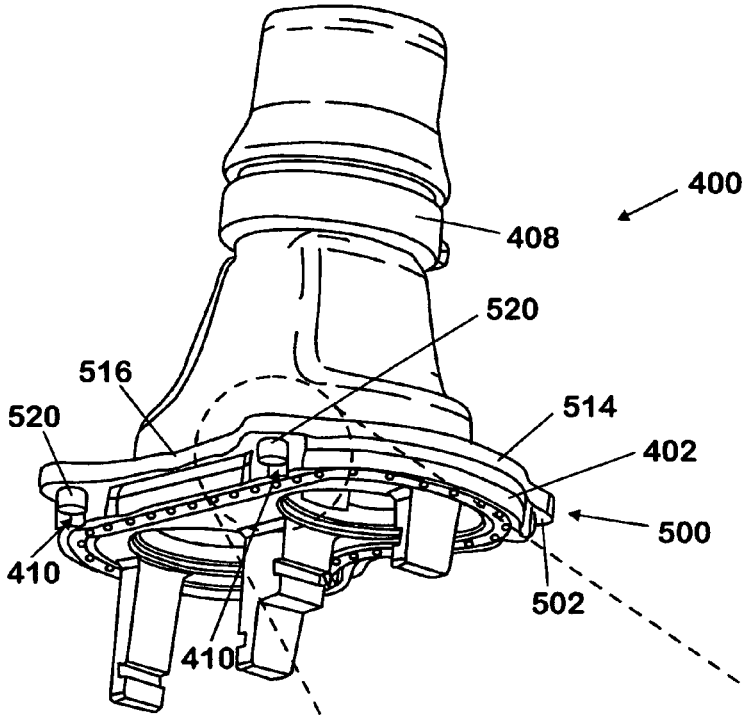
FIG. 6 is an outline view of the component shown in FIG. 4 having the hold-down plate shown in FIG. 5 attached thereon in accordance with the invention.
Figure 7:
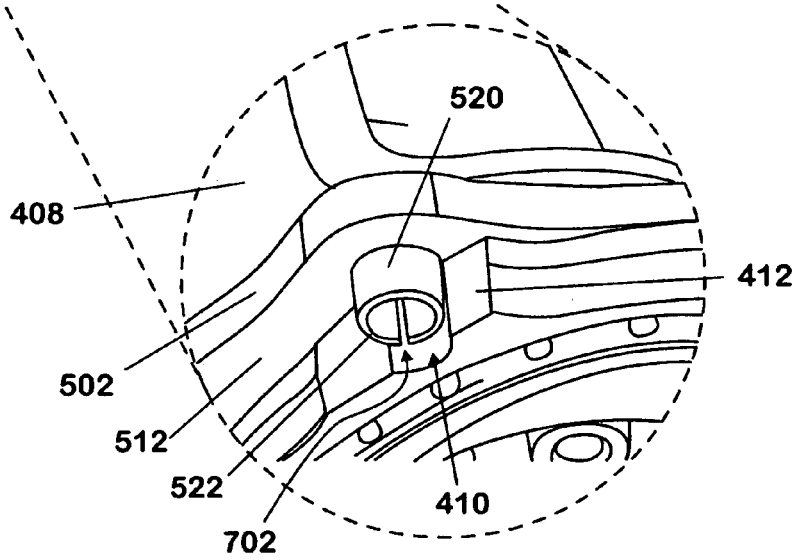
FIG. 7 is a large scale detail view of a guide element disposed in a guide opening in accordance with the invention.

An overview of the component 400 having the hold-down plate 500 in an as-installed position is shown in FIG. 7, with a detailed magnified view shown in FIG. 7. The support member 502 is associated with the flange 402 and rests on it, with other features of the housing 408 located within the opening 504. Each guide element 520 advantageously occupies its respective guide channel 410. During installation of the hold-down plate 500 to the component 400, each guide element 520 may slide on one or both guide pads 412 that flank each guide channel 410 before resting in the guide channel 410. In the as-installed position shown if FIGS. 6 and 7, the non flat portions 516 of the support member are in contact with the housing 408 on an adjacent face of the flange 402, and also, portions of each of the distal end points 514 are also in contact with the housing 402 in a similar fashion.

In one embodiment, shown in the detailed view of FIG 7, each guide member 520 has a slit 702 that extends along the entire length of each guide member 520. In this embodiment, the guide members 520 may be made of a rolled plate, preferably a plate of spring steel, and have a residual stress that acts to flatten them, but other materials may be used. Because of the residual stress, the guide members 520 act as springs that impart a lateral load in each opening 518 when installed to help retain their position. Alternatively, the guide members 520 may be press-fit into their respective openings 518, or otherwise installed by any known process or processes.

Figure 8:
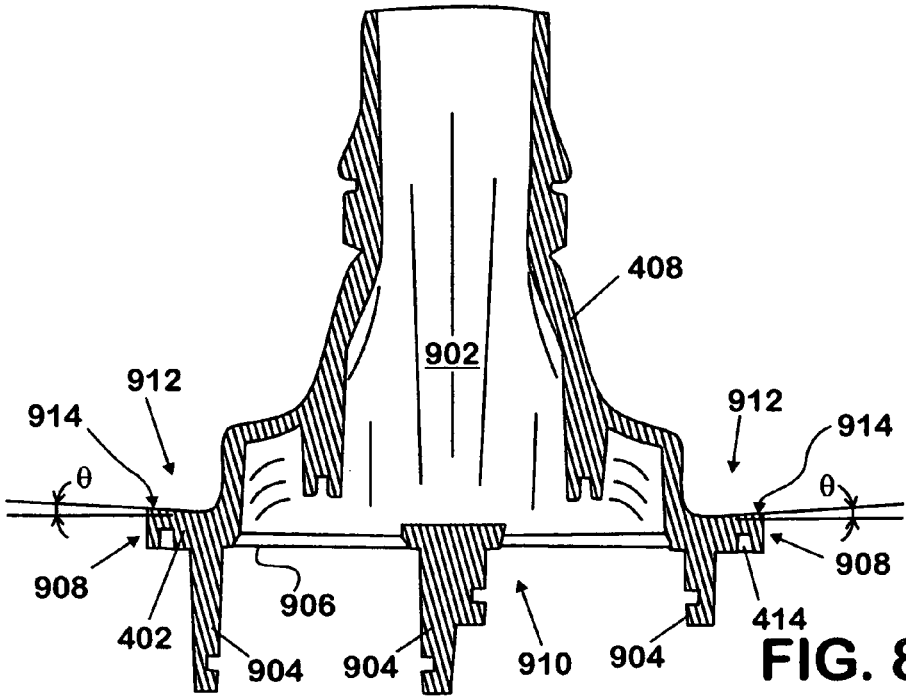
FIG. 8 is a cross-section view of a housing of the component shown in FIG. 4 having draft angle features formed on a mating flange in accordance with the invention.

A cross-section view of the housing 408 of the component 400 is shown in FIG. 8. The housing 408 encloses an inner cavity 902 and form protrusions 904 that are arranged to engage features (not shown) of the first and second thermostats 404 and 406 (shown in FIG. 4). The flange 402 on the housing 408 has a mating-side or lower surface 906 that surrounds and follows the groove 414. The flange 402 has a set of distal end portions 908 that correspond to areas of contact with the distal end portions 514 of the hold-down plate 500 when the hold-down plate 500 is assembled onto the housing 400. A set of middle portions 910 are symmetrically located between the distal end portions 908 on the housing, and are arranged to contact the non flat portions of the hold-down plate 500. Any contact areas between the housing 400 and the hold-down plate 500 are located along an outer or opposite surface 912 of the flange 402. The surface 912 is located on the flange 412 on an opposite side thereof with respect to the mating-side surface 906.

The housing 408 may advantageously be made of metal, preferably aluminum, and be formed using a die-cast process. A die separation direction used during formation of the housing 408, in the region of the distal end portions 908, on the side of the outer surface 912, may be away from the flange 402. Thusly, a set of draft angle features 914 may be formed on the flange 402, at each of the distal end portions 908, which extend away from the outer surface 912. The draft angle features 914 may form an angle, θ, with the otherwise substantially flat outer surface 912. The draft angle features 914 facilitate separation of the dies (not shown) used to cast the housing 408, and more advantageously, create a "unit load" condition between the housing 408 and the hold-down plate 500 to increase a compressive load imparted by the hold-down plate 500 onto the housing 408 at the distal end portions 908 thereof.

Figure 9:
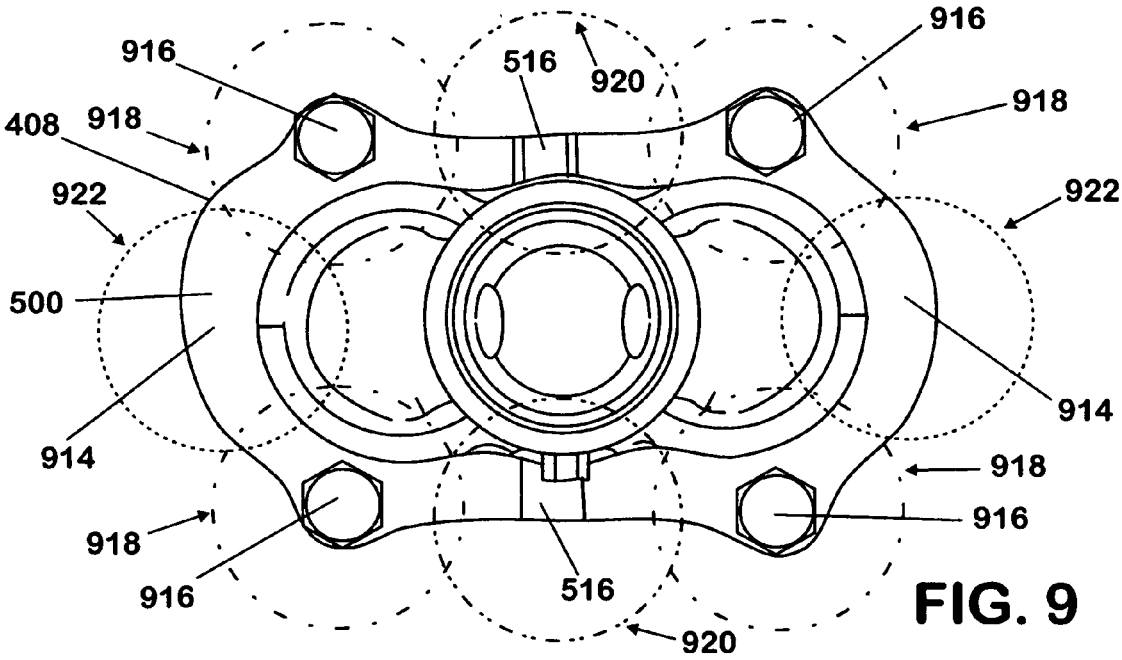
FIG. 9 is an outline view showing a loading condition of the component of FIG. 4 in an as-installed position in accordance with the invention.

An outline view of the housing 400 in an as-installed position having the hold-down plate 500 attaching same is shown in FIG. 9. A plurality of fasteners 916 is used to fasten the plate 500 onto an engine (not shown). Each of the fasteners 916 pass through each central cavity 524 of each of the openings 518 in the hold-down plate 500, and through each guide channel 410 of the housing 408, before threadably engaging the engine.

While the hold-down plate 500 is connected with the housing 408, there is a compressive load imparted therebetween in various areas. Firstly, each of the fasteners 916 imparts a load on the housing 408 within areas adjacent to the fasteners 916, or, within a plurality of load circles 918, shown in line-dot-line markings. Secondly, each of the two non-flat portions 516 contacts the housing 408 imparting thereto a unit load, or, a concentrated compressive load in each of the middle portions 910 thereof. Each non-flat portion 516 can create a load circle 920 within an area adjacent to the non-flat portion 516, shown in dot-dot-line markings. Each load circle 920 is created by the concentration of loading from the fasteners 916 onto the hold-down plate 500, and through the hold-down plate 500, through each of the non-flat portions 516, onto the housing 408. Thirdly, each of the draft angle features 914, due to their protrusion away from the housing 408, contact the hold-down plate 500 in a concentrated area and allow a concentrated compressive load therebetween to be imparted. Each of the draft angle features 914 advantageously create a load circle 922 within an area adjacent to each draft angle feature 914, shown in dotted line markings.

Proper selection of material thickness, feature size, fastener size, and material composition for the various components and features described advantageously allows each of the load circles 918, 920, and 922 to overlap when the hold-down plate 500 is assembled to an engine through the housing 408. In the embodiment shown as depicted in FIG. 9, each of the load circles 918, 920, and 922 overlap to cover the entire flange interface between the hold-down plate 500 and the housing 408. Complete coverage of the flange interface advantageously ensures proper operation of the seal (not shown here) therebetween by use of fewer fasteners that would have been required had the additional load circles 920 and 922 not been present.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A hold-down plate for securing a first component to a second component having a seal disposed between the first component and the second component, the hold-down plate comprising:

a support member having a central opening, wherein the support member has an outer face and an inner face that are substantially flat, wherein the central opening is surrounded by an inner periphery of the support member, and wherein the support member has an outer periphery;

a plurality of guide elements, wherein each of the plurality of guide elements is disposed into each of a plurality of openings formed in the support member, wherein each of the guide elements has an outer wall surrounding a central cavity;

wherein the support member has at least two distal end points, each distal end point disposed between two consecutive openings, and wherein the support member has at least two non-flat portions formed in the support member, each non-flat portion disposed between two consecutive openings.

2. The hold-down plate of claim 1, wherein each of the plurality of openings in the support member is disposed adjacent to a distal end portion and to a non-flat portion.

3. The hold-down plate of claim 1, wherein each guide element comprises a rolled member having a lateral surface that forms the outer wall, wherein a slit is formed where two distal ends of the rolled member meet, and wherein the rolled member has a residual stress that acts to retain the guide member in the opening of the support member.

4. The hold-down plate of claim 1, wherein each of the non-flat portions includes a curved surface that extends away from the inner face of the support member.

5. An internal combustion engine having a flanged connection arrangement between a first component and a second component, comprising:

a mounting flange formed on the first component having a flat surface, wherein a plurality of openings is formed adjacent to an outer periphery of the flat surface;

a mating flange formed on the second component, wherein the mating flange has a flat surface that is arranged to mate with the flat surface of the mounting flange, wherein the mating flange has at least two draft-angle features disposed and at least two middle portions;

a plurality of guide openings formed in the mating flange, wherein each of the plurality of guide openings is arranged to correspond to each of the openings in the mounting flange;

a hold-down plate having a plurality of holes formed in a support member, wherein each of the plurality of holes is arranged to align with each of the plurality of openings in the mounting flange, and wherein the support member has at least two distal ends and at least two non-flat protrusions;

a plurality of guide elements engageably disposed in the support member of the hold-down plate, wherein each of the plurality of guide elements is disposed in each of the holes in the support member, and wherein each of the plurality of guide elements is at least partially disposed in each of the plurality of guide openings;

a plurality of fasteners, wherein each of the plurality of fasteners passes through each of the plurality of holes in the support member, through each of the guide elements, and is connected to the mounting flange at each of the plurality of openings;

wherein the hold-down plate is in contact with an outer surface of the mating flange at the at least two distal ends and at the at least two non-flat protrusions.

6. The internal combustion engine of claim 5, wherein each of the plurality of guide elements includes a central cavity through which each of the plurality of fasteners passes, and wherein each of the plurality of guide elements includes an outer wall that is contacting each of the plurality of guide openings.

7. The internal combustion engine of claim 5, further comprising at least one guide pad disposed adjacent to at least one of the guide openings in the mating flange.

8. The internal combustion engine of claim 5, wherein at least one of the mounting flange and the mating flange forms a seal channel disposed along an entire periphery thereof, the seal channel formed as a concave channel away from at least one of the flat surface of the mounting flange and the flat surface of the mating flange, wherein the internal combustion engine further comprises a string seal disposed in the seal channel.

9. The internal combustion engine of claim 5, wherein a plurality of overlapping load circles that are formed by contact areas adjacent to at least one of the plurality of fasteners, the at least two distal ends, and the at least two non-flat protrusions represent a uniform compressive load along an entire periphery of the mating flange.

10. A method of connecting a first component with a second component using a hold-down plate, comprising the steps of:

placing the second component in contact with the first component along a flanged interface, such that a mounting flange formed in the first component contacts a mating flange formed in the second component;

passing the hold-down plate around the second component such that at least a portion of the second component passes through a central opening of the hold-down plate;

aligning the hold-down plate with the second component by engaging a plurality of guide elements that are disposed on the hold-down plate with a plurality of guide openings that are formed around an outer periphery of the mating flange;

aligning the second component with the first component by inserting a plurality of fasteners through the plurality of guide elements such that each of the plurality of fasteners threadably engages each of a plurality of threaded openings that are formed in the mounting flange; and tightening each of the fasteners to impart a compressing load between the hold-down plate, the mating flange, and the mounting flange;

wherein the compressing load is distributed in discrete locations along the periphery of the mating flange, and wherein the discrete locations include locations that are adjacent to each of the plurality of fasteners, to at least two non-flat portions formed in the hold-down plate, and to at least two distal end points of the mating flange, each distal end point having a draft angle protrusion feature formed thereon.

11. The method of connecting a first component with a second component using a hold-down plate as recited in claim 10 wherein each discrete location applies a portion of the compressive load within a respective load circle, and wherein each respective load circle overlaps with each adjacent load circle.

12. The method of connecting a first component with a second component using a hold-down plate as recited in claim 11 wherein the overlap between each load circle with each adjacent load circle extends along an entire periphery of the mating flange.

* * * * *